US007140566B2

(12) United States Patent
Hughes

(10) Patent No.: US 7,140,566 B2
(45) Date of Patent: Nov. 28, 2006

(54) RING AND DISK REFINER

(75) Inventor: John H. Hughes, Montesano, WA (US)

(73) Assignee: Comcorp, Inc., Montesano, WA (US)

( * ) Notice: Subject to any disclaimer, the term of this patent is extended or adjusted under 35 U.S.C. 154(b) by 319 days.

(21) Appl. No.: 10/324,545

(22) Filed: Dec. 19, 2002

(65) Prior Publication Data

US 2004/0118956 A1 Jun. 24, 2004

(51) Int. Cl.
*B02C 13/286* (2006.01)

(52) U.S. Cl. ..... 241/101.761

(58) Field of Classification Search ..... 241/101.761, 241/186.4

See application file for complete search history.

(56) References Cited

U.S. PATENT DOCUMENTS

| | | | |
|---|---|---|---|
| 617,523 | A | 1/1899 | Day |
| 1,324,389 | A | 12/1919 | Ekola |
| 1,736,563 | A | 11/1929 | Wilmot |
| 1,903,526 | A | 4/1933 | Andrews |
| 2,012,602 | A | 8/1935 | Forrester |
| 2,033,123 | A | 3/1936 | Cowles |
| 2,045,691 | A | 6/1936 | Armstrong |
| 2,620,138 | A | 12/1952 | Vazieux et al. |
| 2,796,807 | A | 6/1957 | Sanford |
| 2,865,572 | A | 12/1958 | Lannert |
| 3,037,540 | A | 6/1962 | Bloomquist et al. |
| 3,143,303 | A | 8/1964 | Palyi |
| 3,314,617 | A | 4/1967 | Sargood |
| 3,319,897 | A | 5/1967 | Craig et al. |
| 3,528,617 | A | 9/1970 | Trevathan |
| 3,615,059 | A | 10/1971 | Moeller |
| 3,713,595 | A | 1/1973 | Craig et al. |
| 3,741,104 | A | 6/1973 | Kannegiesser |
| 3,823,633 | A | 7/1974 | Ross |
| 3,936,005 | A | 2/1976 | Schnell |
| 3,955,765 | A | 5/1976 | Gaitten |
| 3,964,716 | A | 6/1976 | McCorkle et al. |
| 3,979,078 | A | 9/1976 | Böddeker et al. |

(Continued)

FOREIGN PATENT DOCUMENTS

| | | |
|---|---|---|
| EP | 0121751 A1 | 10/1984 |

(Continued)

OTHER PUBLICATIONS

Photograph of a comminuter implement in the bottom of a comminuter sold by Universal Refiner Corporation before Aug. 28, 1997.

*Primary Examiner*—Daniel C. Crane
(74) *Attorney, Agent, or Firm*—Christensen O'Connor Johnson Kindness PLLC

(57) ABSTRACT

A refiner that reduces solid material to a particulate form includes a rotatable sidewall, a bottom, at least one exit hole, and a rotatable toothed disk. One or more baffles may be attached to the chamber sidewall to form one or more surfaces that extend into the chamber. The baffles help move the solid material toward the rotating toothed disk. The baffles also limit material from being inadvertently thrown out of the chamber. A moveable gate may be positioned to change the size of the exit hole and thus regulate the size of particulate material exiting the chamber. The position of the gate may be adjusted during the operation of the refiner chamber. A gate indicator indicates the relative position of the particle size gate. One or more attachments to the bottom of the chamber may be used to limit the amount and/or size of material engaging the toothed disk.

39 Claims, 7 Drawing Sheets

U.S. PATENT DOCUMENTS 4,033,515 A * 7/1977 Barcell et al. ..... 241/27
4,106,706 A 8/1978 Burrows
4,120,460 A 10/1978 Bacher
4,243,183 A 1/1981 Eirich et al.
4,267,982 A 5/1981 Hooper
4,325,516 A 4/1982 Ismar
4,366,928 A 1/1983 Hughes
4,448,361 A 5/1984 Marcy
4,454,995 A 6/1984 Bloomquist
4,516,732 A 5/1985 Kela et al.
4,583,415 A 4/1986 Locker
4,593,861 A 6/1986 Blakley et al.
4,657,192 A 4/1987 Browning
4,664,320 A 5/1987 Steffens
4,699,326 A 10/1987 Warren
4,736,781 A 4/1988 Morey et al.
4,767,069 A 8/1988 Kim
4,773,601 A 9/1988 Urich et al.
4,790,489 A 12/1988 Paul
4,846,411 A 7/1989 Herron et al.
4,848,682 A 7/1989 Scheler
4,934,615 A 6/1990 Osborne
4,997,135 A 3/1991 Zehr
5,005,772 A 4/1991 Ostergaard
5,058,815 A 10/1991 Pozzato et al.
5,215,268 A * 6/1993 Houle et al. ..... 241/186.4
5,320,292 A 6/1994 Smith
5,379,951 A 1/1995 Hughes
5,570,849 A 11/1996 Anderson
5,927,624 A 7/1999 Hughes
6,000,554 A 12/1999 Hughes
RE36,486 E 1/2000 Hughes
6,663,275 B1 * 12/2003 Knight ..... 366/141

FOREIGN PATENT DOCUMENTS

GB 2122480 A 1/1984
SU 1151302 A 4/1985

* cited by examiner

RING AND DISK REFINER

FIELD OF THE INVENTION

The invention relates to refiners, and more specifically to a ring and disk refiner that reduces solid material to a particulate form.

BACKGROUND OF THE INVENTION

There exists a need in many industries to reduce large pieces of solid material to a particulate form. For instance, in managing wood and tree waste, it is desirable to grind stumps, branches, and wood scraps into smaller wood chips. Wood chips are more easily and efficiently transported, stored, and used for a variety of purposes. In other instances, it is desirable to reduce large pieces of waste material, such as plastic, for recycling or disposal.

Refiners of various size and operation are generally available for performing this function. One style of refiner includes a refining chamber defined by a sidewall and a bottom floor at one end of the sidewall. An annular ring in the same plane and surrounding the bottom floor is attached to the sidewall and rotates with the sidewall. For instance, reissue U.S. Pat. No. Re. 36,486 and U.S. Pat. No. 5,927,624, assigned to the assignee of the present invention, disclose a comminuter, or refiner, of this style. Inside the comminuter chamber, a rotatably-mounted toothed disk impacts solid material introduced into the chamber and reduces the material to particulate form.

The comminuter, or refiner, disclosed in the above-noted patents operates by rotating both the chamber sidewall and the toothed disk, usually in opposite directions. The rotation of the sidewall imparts rotational motion to the solid material placed in the chamber. As the material in the chamber rotates with the chamber sidewall, the material comes into contact with the rotating toothed disk. The teeth on the disk impact the material and thereby rip and tear the material into successively smaller pieces. The annular portion of the bottom of the chamber that rotates with the sidewall typically includes a screened exit through which the material, once refined to a particular size, may pass out of the chamber.

During the refining process, the solid material being refined may be thrown about within the comminuting chamber, particularly when the comminuting chamber is only partially filed. Portions of the material may ricochet off the rotating sidewall and fly out of the open top end of the comminuting chamber. To address this problem, reissue U.S. Pat. Re. 36,486 and U.S. Pat. No. 5,927,624 describe a curtain assembly mounted on top of a hopper stationed above the comminuting chamber. However, the curtain assembly can be complicated to assemble and partially blocks the opening of the hopper, adding some difficulty to loading material into the comminuter. Solid shrouding has also been suggested but that also partially blocks the opening of the hopper and/or comminuting chamber.

Screened exits in the comminuting chamber regulate the size of material that can exit the chamber. U.S. Pat. No. 5,927,624 describes an annular screened exit comprised of a series of grate segments. The grate segments have a plurality of holes, the size of which determine the particle size that can exit the chamber. When the operator desires to change the size of the particulate matter exiting the chamber, the comminuter must be stopped and unloaded, the grate segments removed and replaced with other grate segments having holes of a different size or configuration. Significant downtime of the machine thus occurs every time a change of particulate size is desired.

There is, therefore, a need in the prior art for a refiner with a refining chamber that better confines the material placed in the chamber to prevent it from inadvertently being thrown out. There is also a need for a refiner that is capable of changing the size of particulate matter exiting the refiner in a manner that is faster and easier than hitherto known. These needs, and other shortcomings in the prior art, are addressed by the present invention discussed herein.

SUMMARY OF THE INVENTION

The present invention provides a refiner that is configured to reduce solid material to a particulate form. A preferred embodiment of the invention includes a refiner chamber that has a rotatable sidewall and a bottom disposed across an end of the sidewall. An exit hole is defined in the bottom of the chamber through which particulate material may pass. A toothed disk is rotatably mounted within the chamber to engage the solid material and reduce it to particulate form.

In one aspect, a refiner constructed according to the invention may have a refiner chamber that includes one or more baffles attached to the chamber sidewall. The baffles form one or more surfaces that extend inward into the chamber. The baffles are preferably designed to engage the solid material that has been introduced into the chamber and help move the material toward the rotating toothed disk. The baffles also function to limit the ability of material thrown about within the chamber from being inadvertently thrown out of the chamber. Solid material ricocheting off of the chamber sidewall hits the baffles and is directed downward back into the chamber. The baffles may be oriented on the chamber sidewall at an angle relative to the rotational axis of the chamber and/or at an angle relative to the chamber sidewall.

In another aspect, a refiner constructed according to the invention may have a moveable gate that can be positioned during the operation of the refiner chamber to change the size of the exit hole and thus regulate the size of particulate material exiting the chamber. An operator operating the refiner may communicate a signal to a motor connected to the movable gate to move the gate into a desired position. A gate indicator may further be provided to indicate to the operator the relative position of the particle size gate. In one embodiment, the gate indicator is a bar connected to the mechanical linkage that moves the gate. Depending on the position of the gate, the gate indicator moves relative to markings on the refiner. Electronic gate indication may also be provided.

The refiner chamber may further indicate attachments secured to the bottom of the chamber to assist in the refining process. In one aspect, a riser plate may be positioned next to the rotating toothed disk to direct solid material onto the disk. Smaller, refined material falls toward the floor and is swept under the riser pate toward the exit hole. In another embodiment, one or more floor combs may be used to direct solid material upward toward the toothed disk while permitting smaller, particulate matter to be swept between the floor combs toward the exit hole. A significant advantage of the riser plate and floor combs is that they effectively limit the amount and/or size of solid material that engages the rotating disk and thus function to reduce the possibility of solid material being jammed between the toothed disk and the chamber sidewall, especially when the disk and sidewall are rotating in the same direction. The natural sorting action provided by the floor attachments helps separate the solid material yet to be refined from the particulate material that has been refined. To further help move the solid material within the chamber toward the toothed disk, the chamber sidewall may include one or more cleats and/or or pusher bars that extend from the lower end of the sidewall into the chamber. Scraper plates attached to the lower end of the sidewall may also be used to scrape material collecting at the exit hole and prevent it from clogging the exit hole.

BRIEF DESCRIPTION OF THE DRAWINGS

The foregoing aspects and many of the attendant advantages of this invention will become more readily appreciated as the same become better understood by reference to the following detailed description, when taken in conjunction with the accompanying drawings, wherein.

DETAILED DESCRIPTION OF THE PREFERRED EMBODIMENT

Figure 1:
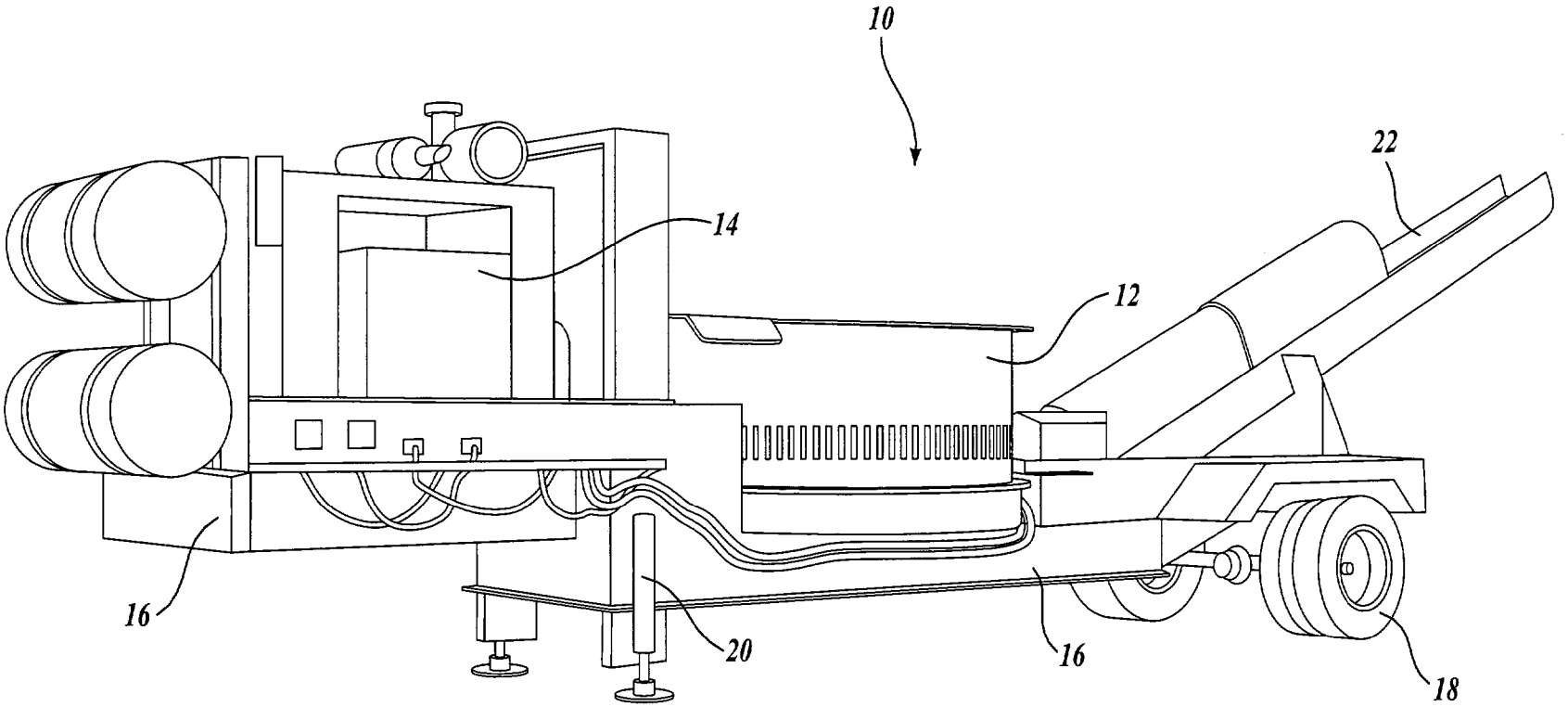
FIG. 1 is a side perspective view of one exemplary embodiment of a ring and disk refiner constructed according to the present invention.

A refiner constructed in accordance with the present invention may be embodied in a variety of forms. Typically, a refiner will include a refiner chamber, a cutter disk, an engine that powers the refiner chamber and cutter disk, and a conveyor that carries away the refined material that has exited the refiner chamber. FIG. 1 is a perspective side view of one exemplary embodiment of such a refiner.

The refiner 10 depicted in FIG. 1 is frequently referred to as a ring and disk refiner, in reference to the rotating refiner chamber 12 and a rotating toothed disk located inside the chamber 12. The refiner 10 includes an engine 14 that powers the operation of the refiner 10. The engine 14 is typically a diesel engine, but other types of engines, such as a gasoline engine may be used. Alternatively, or in addition, other power sources, including electric and hydraulic motors, may be used to operate the refiner 10. The refiner chamber 12 and the engine 14 are mounted on a frame 16 that preferably has wheels 18. The wheels 18 allow the frame 16 to be transported from one job site to another. Adjustable jack legs 20 mounted at an end of the frame 16 opposite the wheels 18 may be used to maintain the refiner 10 in a level position.

The refiner 10 further includes a conveyor 22 that collects and carries away particulate material discharged from the refiner chamber 12. The conveyed particulate material may be deposited in a pile on the ground, in the bed of a truck, etc. Conventional components may be used to construct the conveyor 22 including belt systems, augers, or other mechanisms capable of conveying the particulate matter from the refiner chamber 12. See, e.g., the reciprocating screening conveyor described in U.S. Pat. No. 6,000,554, assigned to the assignee of the present invention and incorporated by reference herein.

Figure 2:
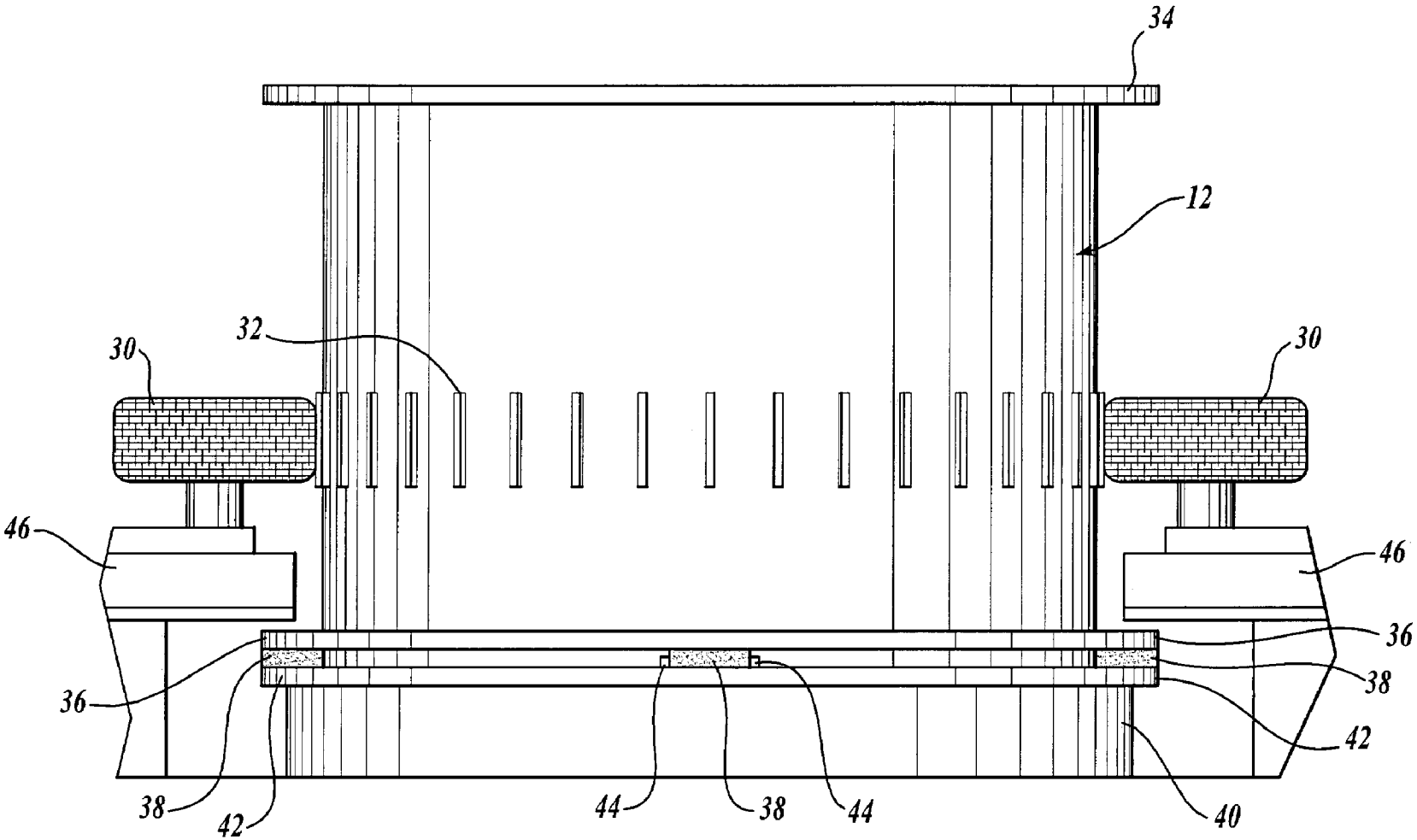
FIG. 2 is a simplified side view of the refiner portion of the ring and disk refiner shown in FIG. 1, including the refiner chamber.

FIG. 2 illustrates in more detail the refiner portion of the refiner 10 shown in FIG. 1. The portion shown in FIG. 2 includes the refiner chamber 12. In this particular embodiment, the refiner chamber 12 is rotated by friction tires 30 that engage the outside surface of the refiner chamber 12. The tires 30 are rotationally driven by the engine 14 shown in FIG. 1 and/or by other motors, such as hydraulic motors, that are powered by the engine 14 or possibly separately powered. Bar shaped protrusions 32 may be formed or attached to the outside wall of the refiner chamber 12 to further engage the tires 30 that rotate the chamber 12. Alternative embodiments of the refiner 10 may use other mechanisms to rotate the refiner chamber 12, including mechanisms such as belts, chains, or gears that engage the chamber sidewall or an axle attached to the chamber.

The refiner chamber 12 shown in FIG. 2 further includes an upper rim 34 and a lower rim 36, either formed integrally with the sidewall of the chamber 12 or separately attached (e.g., welded) thereto. The upper rim 34 surrounds the open end of the chamber 12 through which solid material to be refined enters the chamber 12.

The lower rim 36, in this embodiment, provides a supporting surface on which the chamber 12 rotates. In this embodiment, the lower rim 36 rests upon a low-friction wear-resistant surface, here pads 38, that are in turn supported by a rim 42 of a refiner pan. The pads 38, in one embodiment, are formed with a polytetrafluoroethylene surface material (for example, a fluoropolymer manufactured by DuPont under the trademark Teflon). Teflon pads 38 may be attached to the rim 42 by an adhesive and/or fasteners or mounting brackets 44. In this embodiment, the Teflon pads remain in place while the refiner chamber 12 and lower rim 36 rotate horizontally on the upper surface of the Teflon pads 38. In other embodiments of the invention, the low-friction wear-resistant surface may be comprised of materials other than Teflon and may also extend over the entire surface of the refiner pan rim 42. Other alternative bearing surfaces may also be used, including wheel-shaped or spherical bearings that roll with or against the rotating chamber 12.

Because the refining action inside the chamber 12 can be somewhat violent, the refiner 10 is preferably built to provide some lateral and vertical clearance for movement of the refiner chamber 12. In the embodiment depicted in FIG. 2, the tires 30 accommodate some lateral movement of the chamber 12. Vertical movement of the chamber is accommodated by allowing the chamber 12 to lift off the Teflon pads 38 as needed. For safety purposes, it is preferred that the refiner 10 include one or more limiters 46 that limit the vertical movement of the chamber 12. The limiters 46 are secured to the frame 16 of the refiner 10 and project over the lower rim 36 of the refining chamber 12. Should the refiner chamber 12 lift too high off the Teflon pads 38, the lower rim 36 will hit one or more of the limiters 46, thus limiting the vertical movement of the refiner chamber 12. One embodiment of the invention permits approximately ½ inch lateral movement and approximately 2 inches vertical movement, though other embodiments of the invention may accommodate greater or less movement of the refiner chamber 12.

Figure 3:
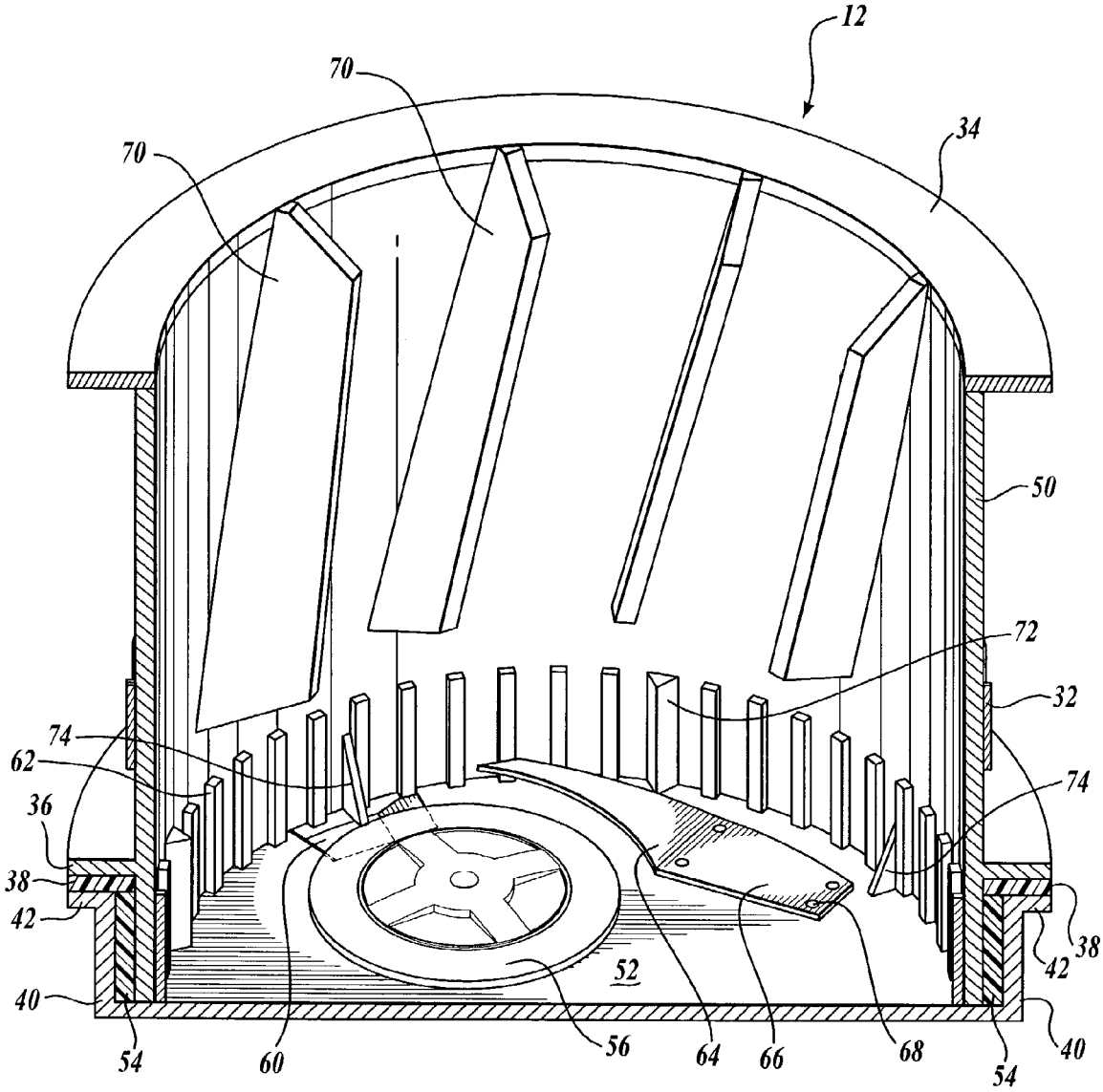
FIG. 3 is a cutaway, perspective interior view of one embodiment of the refiner chamber depicted in FIG. 2.

Material to be refined, such as wood scraps, stumps, plastic material, or other solid material, are fed into the refiner chamber 12 through the open top end of the chamber 12. FIG. 3 illustrates a cut-away upper perspective view of an embodiment of the refiner chamber 12. As previously illustrated, the refiner chamber 12 includes an upper rim 34 and a lower rim 36 attached to a chamber sidewall 50. The lower rim 36 of the refiner chamber 12 rests on a low-friction surface, in this instance Teflon pads 38. The bottom end of the refiner chamber 12 is contained within a refiner pan 40 having an upper rim 42 that supports the Teflon pads 38. A bottom surface of the pan 40 forms a floor 52 of the refiner chamber 12. A low-friction wear-resistant surface 54 disposed between the sidewall of the pan 40 and the sidewall 50 of the chamber 12 locates the sidewall 50 within the pan 40 and helps guide the refiner chamber 12 as it rotates. In one embodiment of the invention, the low-friction wear-resistant surface 54 is comprised of an ultrahigh molecular weight polymer, though other material, including Teflon, may be used. The low-friction surface 54 may completely surround the bottom end of the chamber sidewall 50 or it may be comprised of smaller sections of low-friction material spaced around the chamber sidewall 50.

The refining action of the refiner 10 is provided by rotating both the chamber sidewall 50 and a toothed disk 56 mounted in the chamber 12. For simplicity of illustration, the teeth on the disk 56 are not shown. However, a toothed disk suitable for use in the invention is shown and described in reissue U.S. Pat. No. Re. 36,486, incorporated in its entirety by reference herein. A plurality of cutting teeth are secured at spaced intervals around the periphery of the disk 56 and project outwardly and/or upwardly therefrom at various angles. In a preferred embodiment, the refiner chamber 12 and the toothed disk 56 rotate in the same direction. However, as discussed later herein, the refiner chamber 12 may be configured to rotate in a direction opposite to that of the refiner disk 56. The refiner 10 may also be constructed to rotate the refiner chamber 12 in a forward and reverse direction, as needed.

The rotating sidewall 50 imparts rotational motion to solid material that has been introduced into the refiner chamber 12. When the material comes into contact with the rotating toothed disk 56, the teeth on the disk impact the material, and thereby rip and shred the material into a particulate form.

In the embodiment shown in FIG. 3, the disk 56 and the chamber sidewall 50 both rotate in a counterclockwise direction. Solid material that has engaged the disk 56 and has been reduced to particulate form falls toward the floor 52 and is thrown toward an exit hole 60 defined in the floor 52. The exit hole 60 is preferably located above a conveyer system, e.g., conveyor 22 in FIG. 1, so that particulate matter exiting the chamber 12 can be carried away from the refiner. See also FIG. 5 and the related discussion below.

Various protrusions on the interior of the sidewall 50 shown in FIG. 3 perform a number of functions in refining solid material in the chamber 12. For instance, one or more cleats 62 may be formed with, or attached to, the lower inside end of the chamber sidewall 50. Where a plurality of cleats 62 are used, the cleats are preferably spaced around the inner circumference of the sidewall 50. In one aspect, the cleats 62 engage the solid material in the chamber and help rotate the solid material toward the rotating toothed disk 56. As the solid material approaches the toothed disk 56, the cleats 62 also provide an anvil surface against which the material is held while the teeth on the disk impact the material and reduce it to particulate form.

The toothed disk 56 preferably rotates at a much higher speed than the chamber sidewall 50. The teeth on the disk 56 may thus impact the solid material numerous times as it is held by the cleats 62 and rotated with the sidewall 50. The particulate matter refined from the solid material drops to the floor 52 and is thrown or swept toward the exit hole 60. Larger chunks of material not reduced to particulate form in a pass by the rotating toothed disk 56 are rotated around the refiner chamber 12 and brought again into contact with the toothed disk 56.

To help separate larger pieces of solid material from the refined, particulate material, one or more attachments may be secured to the floor 52, preferably in a location next to the rotating disk 56. In the embodiment shown in FIG. 3, a riser plate 64 is attached to the floor 52. At one end, the rise plate 64 is integrally formed with or secured to a mounting plate 66. The mounting plate 66 is secured to the floor 52, e.g., via bolts 68. The riser plate 64 extends upwardly at an angle from the floor 52. The riser plate 64 also preferably has an edge that conforms in shape to the circular edge of the toothed disk 56.

Figure 4:
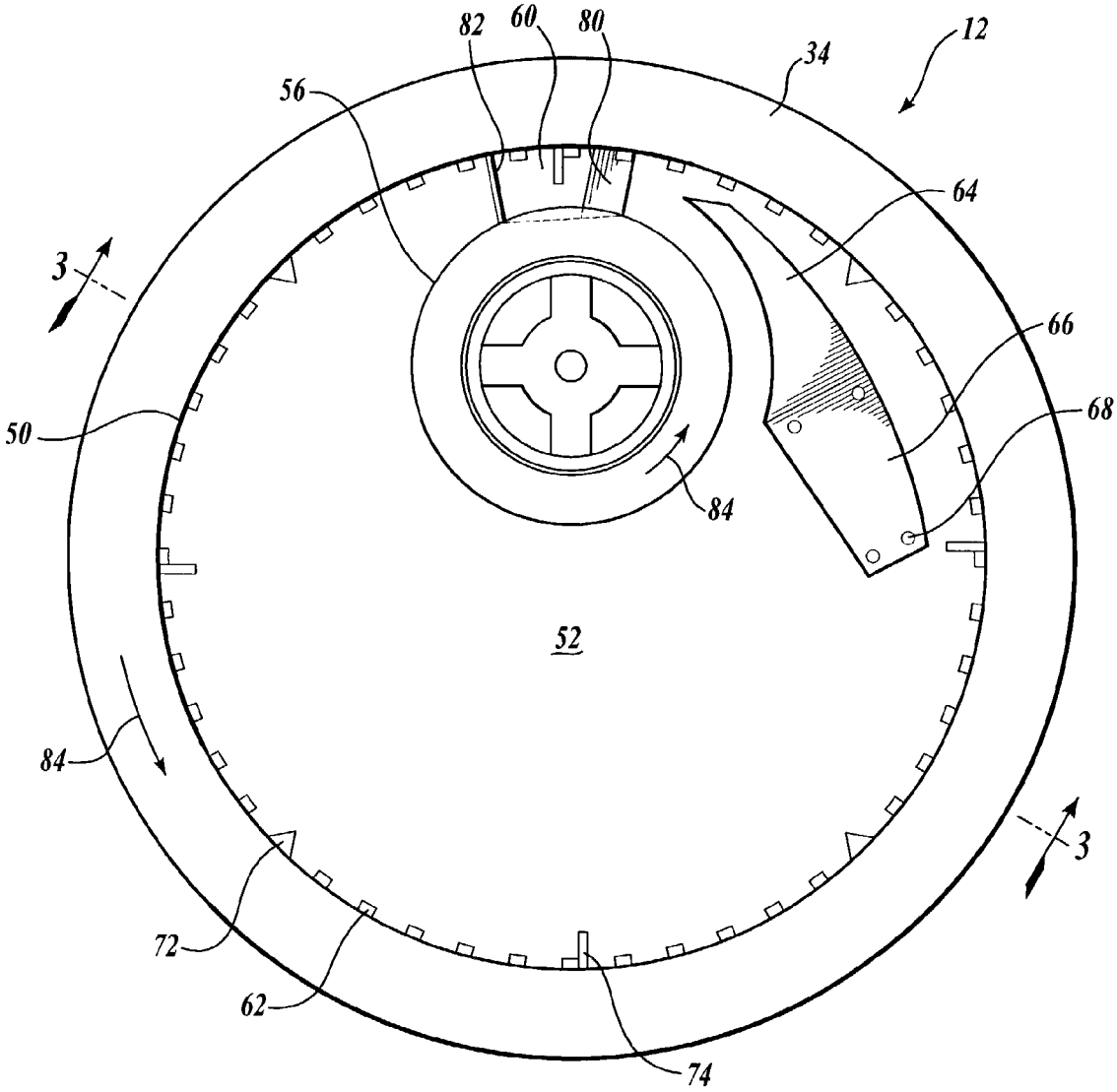
FIG. 4 is a top view of the refiner chamber depicted in FIG. 3, with the sidewall baffles removed.
Figure 5:
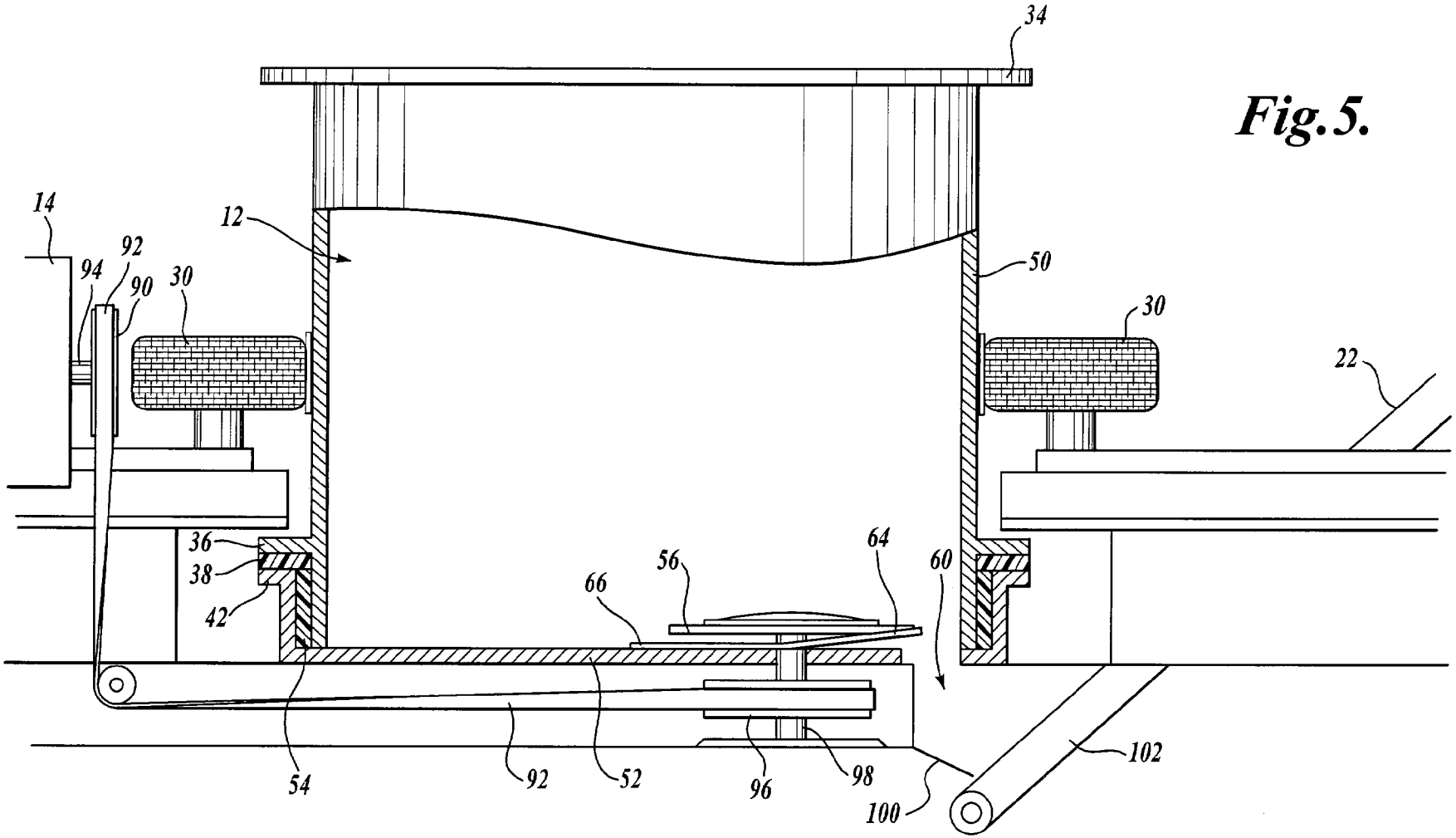
FIG. 5 is a sectional side view of the refiner portion depicted in FIG. 2.

When the riser plate 64 is positioned at the incoming feed side of the toothed disk 56, solid material that is rotated toward the toothed disk 56 encounters the riser plate 64 which directs the solid material upward toward the teeth on the disk 56. Particulate matter that is refined from the solid material falls towards the floor and may pass under the riser plate 64 toward the exit hole 60. The riser plate 64 thus assists in the refining action by helping position the solid material between the toothed disk 56 and the sidewall 50, while helping separate the smaller particulate matter on the floor 52 from the larger solid material. The riser plate 64 also helps limit the amount and/or size of solid material that is held between the toothed disk 56 and the sidewall 50, which may reduce the power consumption of the refiner and further reduce the possibility of damage to the refiner by solid material jamming the toothed disk 56. FIGS. 4 and 5, discussed below, further depict the riser plate 64 in this embodiment of the invention.

The refiner chamber 12 may further include one or more baffles 70 that project radially inwardly from the chamber sidewall 50 into the chamber 12. In FIG. 3, the baffles 70 are disposed on the chamber sidewall 50 at an angle relative to the rotational axis of the refiner chamber 12, and provide one or more surfaces that project from the chamber sidewall into the chamber, preferably from the upper to mid-chamber sidewall. In one embodiment, the baffles 70 have a surface width that extends four to six inches from the sidewall into the chamber. Preferably, the baffles 70 have a surface width that extends into the chamber at least 10% of the radius of the chamber. The baffles 70 provide a number of advantages to the refiner chamber 12. For instance, the baffles 70 engage the solid material that has been introduced into the chamber 12 and helps move the material toward the rotating toothed disk 56. When long pieces of material, such as tree branches, are introduced into the chamber 12, the material sometimes bridges across some or all of the chamber 12 and prevents solid material from descending downward to engage the rotating toothed disk 56. The baffles 70 help break up and/or dislodge such bridging material, so the solid material can be more efficiently refined. Another advantage of the baffles 70 is that they limit the ability of material thrown about in the chamber 12 to be inadvertently thrown out of the chamber. Solid material ricocheting off the chamber sidewall 50 hits the baffles 70 and is directed downwardly back into the chamber 12. The baffles need not be oriented at any particular angle to the rotational axis of the chamber 12 to be effective. However, it is preferred that the baffles 70, when included in the chamber 12, be oriented at some angle from the rotational axis of the chamber 12. The baffles 70 may also be oriented at an angle relative to the surface of the chamber sidewall, or they may project perpendicularly from the sidewall into the chamber 12. Furthermore, the baffles 70 should be securely attached to the chamber sidewall 50 to withstand the tensions and pressures of engaging the solid material introduced into the chamber 12.

Additional projections from the chamber sidewall 50 into the chamber are shown in FIG. 3. For instance, an embodiment of the invention may include one or more pusher bars 72 located around the bottom portion of the chamber sidewall 50. The pusher bars 72 generally project farther into the chamber 12 than the cleats 62. The pusher bars 72 may be taller or shorter than the cleats 62. Because the pusher bars 72 generally extend farther into the chamber 12, the bars 72 are capable of engaging a greater amount of solid material than the cleats 62 and help move the solid material toward the rotating toothed disk 56. There is no particular form or shape that the pusher bars must take. The embodiment shown in FIG. 3 uses a triangular-shaped pusher bar 72.

As depicted in FIG. 3, and better observed in FIG. 4, the exit hole 60 has a front edge 80 and a back edge 82. The front edge 80 may be configured to slant downward from the floor 52 as shown in FIGS. 3 and 4. The slanted front edge 80 guides the refined material that is exiting the chamber 12 downward towards the hole 60. Other embodiments of the invention may not have a slanted front edge 80.

The back edge 82 is preferably rounded downward towards the hole 60 and curve to the underside of the floor 52. Providing a rounded edge for the back edge 82 helps limit the amount of refined and semi-refined material that may wrap around the back end 82 and clog up the hole 60. To further reduce the amount of material that may catch and collect on the back edge 82, the chamber sidewall 50 may further include one or more scrapers 74. The scrapers 74 may be formed of a metal plate that projects radially inwardly from the chamber sidewall 50 along the bottom edge of the chamber 12. In FIG. 3, the scrapers 74 are depicted as triangular-shaped, though other shapes may be used. As the chamber sidewall 50 rotates, the scrapers 74 come into contact with material that may have been caught against the back edge 82 of the hole 60 and help dislodge that material from the back edge 82. The scrapers 74 may be attached to the chamber sidewall 50 either adjacent to the one or more cleats 62 or pusher bars 72, or separately from the cleats or pusher bars.

It should be noted that the baffles 70 shown in FIG. 3 are not included in FIG. 4. Moreover, in FIG. 4 the toothed disk 56 is shown in dotted line to illustrate its respective position in the chamber 12. As noted by the arrows 84 in FIG. 4, both the refiner chamber 12 and the toothed disk 56 rotate in a counterclockwise direction during normal operation. Should a piece of solid material jam between the disk 56 and the chamber sidewall 50, the refiner 10 is preferably configured to enable a reverse rotation of the chamber sidewall 50 to dislodge the jammed material. The chamber sidewall 50 may then return to normal, counterclockwise rotation. As noted later in reference to FIG. 7, other embodiments of the invention may provide a chamber sidewall 50 and toothed disk 56 that rotate in opposite directions.

FIG. 5 depicts a sectional side view of the refiner chamber 12 shown in FIG. 2. As previously described, the refiner chamber 12 includes a sidewall 50, an upper rim 34, and a lower rim 36 that rotates on low-friction pads 38. Tires 30 rotationally engage the outer surface of the sidewall 50 to impart rotational motion to the refiner chamber 12. An engine 14 preferably provides the power to rotate the tires 30.

Inside the chamber 12 as shown, a riser plate 64 connected to a mounting plate 66 on the chamber floor 52 helps direct solid material towards the rotating toothed disk 56 and limit the amount and/or size of solid material engaging the disk 56. Refined material exits the chamber 12 through the exit hole 60.

The toothed disk 56 may be rotated by any conventional means. In the embodiment depicted in FIG. 5, a belt and pulley system is used. The engine 14 rotates a shaft 94 that is connected to a pulley 90. Wrapped around the pulley 90 is a belt 92 that extends to and engages a pulley 96 for rotating the toothed disk 56. The pulley 96 is connected to a shaft 98 that extends upward through the floor 52 of the chamber 12 and connects to the disk 56.

Particulate matter that exits the chamber 12 through the hole 60 is directed by a guide plate 100 toward a conveyor system 22. In the embodiment depicted in FIG. 5, the conveyor system 22 is comprised of a conveyor belt 102, though other embodiments of the invention may use other mechanisms for conveying the refined material.

Figure 6:
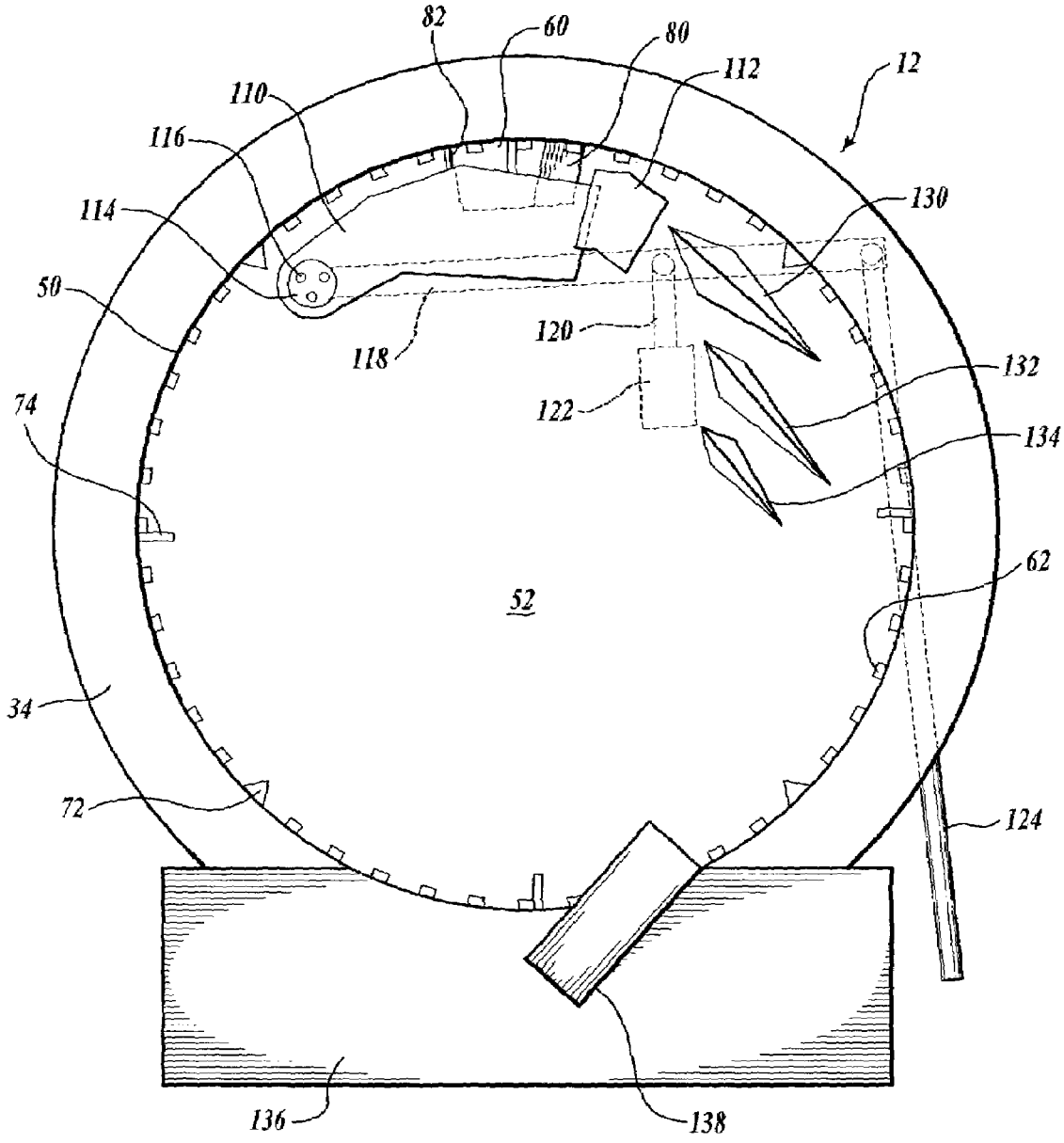
FIG. 6 is a top view of a refiner chamber depicting various floor attachments, and also depicting a rim scraper plate and breaker bar resting on an upper rim of the refiner chamber.

FIG. 6 is a top view of a refiner chamber 12 with various preferred and alternative floor attachments provided therein. FIG. 6 also depicts a rim scraper and breaker bar that will be discussed in more detail below.

A preferred embodiment of the invention includes a moveable gate 110 that can be positioned away from or over part or all of the exit hole 60 to regulate the size of particulate matter exiting the chamber 12. To avoid undue complexity in the drawing, the toothed disk 56 is not illustrated but generally extends over the particle size gate 110 in a plane above the gate 110.

The leading edge of the gate 110 is preferably all or partially protected by a guard plate 112 that is secured to the floor 52. The guard plate 112 extends over the leading edge of the particle size gate 110 and thus defines a slot between the guard plate 112 and the floor 52 through which the particle size gate 110 may move. In one aspect, the guard plate 112 helps prevent solid and particulate matter from collecting around and under the particle size gate 110 and possibly jamming its operation. Guard plates may be positioned to protect other edges of the particle size gate 110 as well.

In the embodiment shown in FIG. 6, the trailing end of the particle size gate 110 is connected to a shaft 114 that extends through the floor 52. Bolts 116 secure the particle size gate 110 via the shaft 114 to a driver bar 118 located beneath the floor 52. The driver bar 118, as shown in this embodiment, extends from the shaft 114 toward an outer edge of the chamber 12. Under the floor 52 is an actuator 122 connected to the driver bar 118 via linkage 120. The actuator 122, in one exemplary embodiment, is a hydraulic actuator, such as a hydraulic cylinder. An operator operating the refiner 10 communicates a signal, either mechanical or electrical, to the hydraulic actuator 122, which in turn either pushes or pulls the driver bar 118 to control the position of the particle size gate 110. In the embodiment shown, when the hydraulic actuator 122 pulls the driver bar 118 towards the middle of the refiner chamber 12, the particle size gate 110 is likewise pulled in a direction toward the middle of the chamber 12, thus exposing the exit hole 60. As the actuator 122 pushes the driver bar 118 toward the outer edge of the chamber 12, the particle size gate 110 is likewise driven in a direction toward the chamber sidewall, thus partially occluding the exit hole 60. At a fully closed position, the particle size gate 110 is positioned proximate to the cleats 62 that are attached to the chamber sidewall 50. With the gate 110 in this closed position, only particles that fit between the cleats 62 will be able to exit the slot between the particle size gate 110 and the chamber sidewall 50 that define the exit hole 60. In this manner, the cleats 62, in combination with the particle size gate 110, provide a three dimensional screening of the refined particles in the chamber 12.

A significant advantage of this embodiment of the invention is that the size of particulate matter exiting the refiner chamber 12 may be adjusted on-the-fly while the refiner 10 is operating. In contrast to the prior art where, to regulate the particle size, the refiner 10 must be shut down to remove and replace the exit screens, the present invention allows the machine to continue operating while the particle size is regulated. The refiner 10 may be configured with a button, lever, switch, or the like, that the operator of the refiner may use to communicate with the hydraulic actuator 122. In yet another embodiment, a wireless remote control may be provided to the operator to communicate with the hydraulic actuator 122. The operator may thus be standing at a location remote from the operating refiner 10 and regulate the particle size via remote control. The particle size is regulated by adjusting the position of the particle size gate 110 over the exit hole 60.

The gate 110 may also be secured to the floor 52 using releasable fasteners. When the fasteners are released, the gate may be moved to a desired position, and when fastened, the gate 110 is secured to the floor 52. In one embodiment, the releasable fasteners may be comprised of bolts that, when loosened, release the gate 110 to be moved, and when tightened, secure the gate 110 to the floor 52.

To indicate to the operator of the refiner 10 the relative position of the particle size gate 110, a gate indicator may be provided. In FIG. 6, a mechanical gate indicator 124 is provided by connecting a bar to the distal end of the driver bar 118, as shown. As the driver bar 118 is moved by the hydraulic actuator 122 to adjust the position of the particle size gate 110, the gate indicator 124 also moves. A gauge on the machine, which may be simple markings or notches on the machine and/or the gate indicator 124, may report the relative position of the particle size gate 10 to the operator. In other embodiments of the invention, different mechanical, electrical, or electromechanical technologies may be used to indicate the position of the gate 110, including sensors that detect the position of the particle size gate 110 or the driver bar 118. For example, a series of optical sensors may be used to detect the position of the gate 110. Alternatively, a sensor may detect the rotation of the shaft 114, such as a variable resistor attached to the shaft 114, and determine the position of the gate 110. These sensors may communicate the position of the gate 110 to the operator, e.g., by wired or wireless communication. For example, the remote control noted above may have a display that reports the relative position of the particle size gate 110 based on a signal received from the sensors. Conventional wired and/or wireless technology that is well-known in the art may be used.

Further illustrated in FIG. 6 is an arrangement of floor combs 130, 132, 134 that can be used in addition to or in place of the riser plate 64 shown in FIGS. 3–5. The floor combs 130, 132, 134 as shown have a triangular cross-section that increases in height from the floor 52 as the floor combs approach the rotating toothed disk 56 (shown in FIGS. 3–5). The floor combs 130, 132, 134 thus have a leading end positioned on the floor 52 and a trailing end positioned above the floor 52 near the disk 56. When the floor combs 130, 132, 134 are positioned at the incoming feed side of the toothed disk 56, solid material in the chamber 12 that is rotated by the sidewall 50 encounters the floor combs and is directed upward towards the rotating toothed disk 56. Smaller, refined material remains on the floor 52 and passes between the floor combs 130, 132, 134. The refined material is swept along the floor 52 toward the exit hole 60. In addition to the particle size sorting action provided by the floor combs 130, 132, 134, the floor combs also limit the amount and/or size of solid material being fed between the toothed disk 56 and the sidewall 50, which may reduce power consumption and potential damage from jamming as previously discussed in regard to the riser plate 64.

While the floor combs 130, 132, 134 are shown with a triangular cross-section, other cross-sectional shapes may be used. For instance, the floor combs 130, 132, 134 may be formed of flat plate material having a rectangular cross-section. Moreover, while three floor combs are shown in FIG. 6, other embodiments of the invention may include any number of floor combs.

Positioned on the upper rim 34 of the refiner chamber 12 is an optional rim scraper 136 and breaker bar 138. The rim scraper 136 scrapes material that may have collected on the upper rim 34 and moves the material inward into the refiner chamber 12. For example, tree waste that is introduced into the chamber 12 may include branches that catch on the upper rim 34. The rim scraper 136 lays flat on or next to the upper rim 34 and scrapes such material into the chamber 12.

The optional breaker bar 138 shown in FIG. 6 may be formed of a plate material that is welded to the top of the scraper plate 136. As depicted, the breaker bar 138 extends further into the refiner chamber 12. As tree branches and other material are brought into the refiner chamber 12, the breaker bar 138 may engage such material and break it into smaller pieces that are more efficiently refined in the chamber 12. For larger pieces of solid material, the breaker bar 138 may simply reorient the material towards the center of the refiner chamber 12 for more efficient processing. Again, as with FIGS. 4 and 5, the baffles 70 shown in FIG. 3 are not depicted in FIG. 6 but may be used in such embodiments of the invention.

Figure 7:
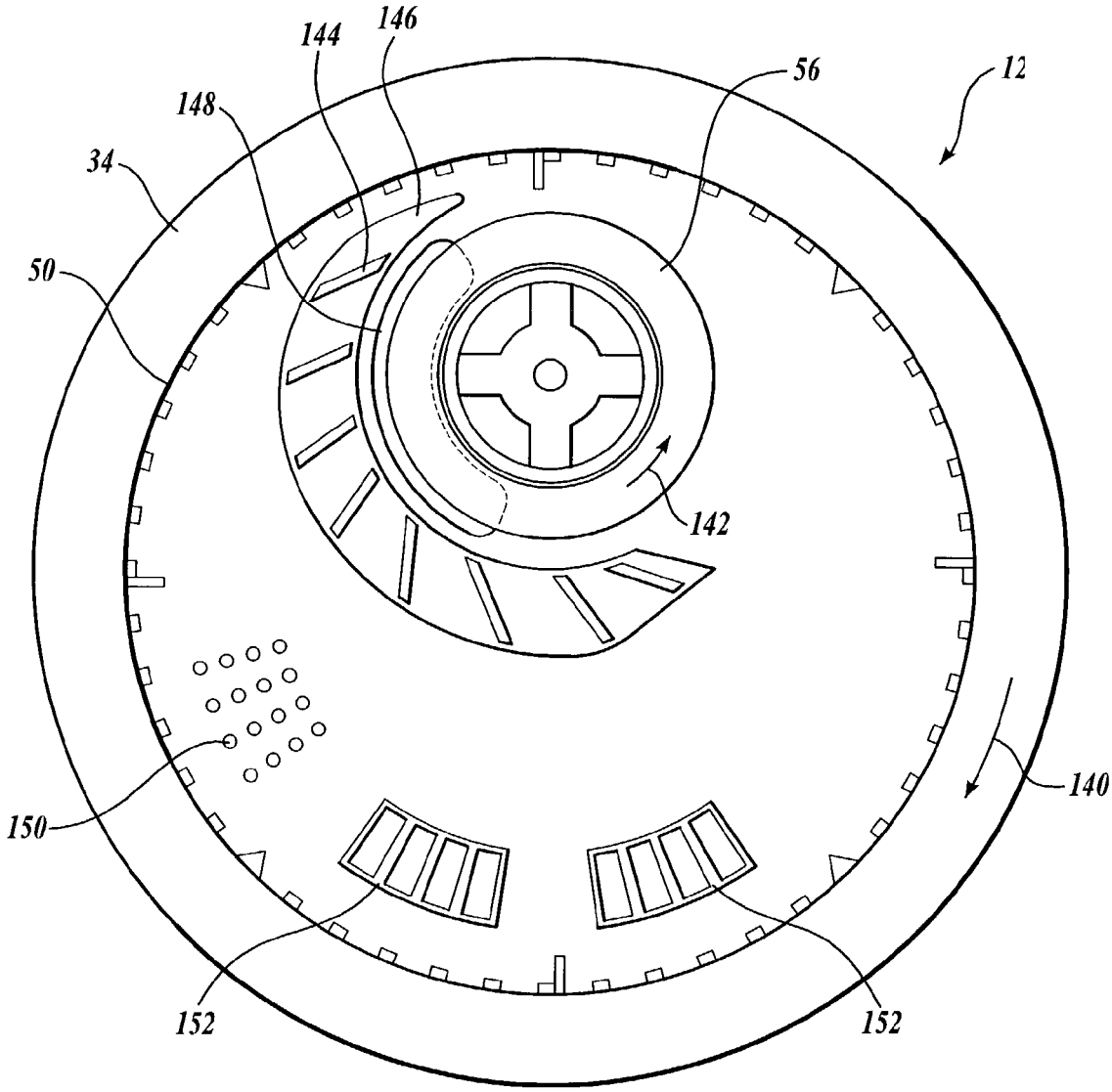
FIG. 7 is a top view of a refiner chamber with alternative floor attachments and exit holes for refined material to exit the chamber.

FIG. 7 illustrates a top view of further alternative embodiments of the refiner chamber 12. In contrast to the embodiments previously described, the embodiments shown in FIG. 7 assume a toothed disk 56 that rotates in a direction opposite to that of the chamber sidewall 50. As indicated by arrows 140 and 142, for example, the chamber sidewall 50 rotates in clockwise direction while the toothed disk 56 rotates in a counterclockwise direction, under normal operation. Where the toothed disk and the chamber sidewall rotate in opposite directions, one or more exit holes may be positioned as desired for the refined particulate material to exit the chamber 12. In FIG. 7, an exit hole 148 is shown having an elongated curved shape partially extending underneath a portion of the rotating toothed disk 56. In other embodiments of the invention, the exit hole 148 may be longer, shorter, wider, or narrower than that shown. The exit hole 148 may also include screens of various size and shape to regulate the size of particulate matter exiting the chamber 12.

As with other embodiments of the invention, the chamber sidewall 50 imparts rotational motion to the solid material in the chamber 12. In this instance, the solid material rotates in a generally clockwise direction. The refiner chamber 12 shown in FIG. 7 may include a series of floor combs 144 attached to a mounting plate 146 on the floor 52. The floor combs 144 are preferably positioned to engage and direct the solid material in the chamber 12 as it is being rotated toward the toothed disk 56. Similar to the floor combs 130, 132, 134 shown in FIG. 6, the floor combs 144 are preferably shaped to have a leading edge close to the floor and trailing edge raised above the floor so that solid material that engages the floor combs is directed up toward the toothed disk 56, while smaller, particulate matter passes between the combs toward the exit hole 148. The floor combs 144, as shown, are formed of a flat plate material having a rectangular cross-section, though other cross-sectional shapes may be used. Moreover, other embodiments of the invention may include greater or fewer floor combs than that shown in FIG. 7.

To illustrate further alternative embodiments, the refiner chamber 12 in FIG. 7 is shown with other forms of exit holes that may be used. The exit holes 150 may be comprised of a plurality of small bores that may be defined directly in the floor 52 (as shown) or may be defined in a separate plate that is inserted into the floor 52 and supported by support members underneath the floor 52. The exit holes 150 are shown having a circular shape, though other shaped holes may be used. The radius or cross-section of the holes is preferably sized to match the desired size of particulate matter exiting the chamber 12.

Other exit holes may include one or more grate segments 152 that lie on an underlying framework. The grate segments have a plurality of holes formed therein and provide a screening function for the material being refined. The size of the holes in the grate segments 152 determines the particle size that will exit the chamber 12.

While the exit holes 150 and 152 may not be used in a preferred embodiment of the invention, they are nevertheless described herein to demonstrate the flexibility of the invention to address different refining needs in the industry. U.S. Pat. No. 5,927,624, assigned to the assignee of the present invention and incorporated by reference herein, describes additional floor attachments that may be used in the refiner chamber of the present invention. By engaging and reorienting the solid material being refined in the chamber, the floor attachments improve the efficiency of the refiner.

Another floor attachment that may be advantageously used in a refiner chamber of the present invention forms a false floor above the bottom of the chamber. The attachment may be comprised of a planar member of any shape that allows solid material in the chamber to come into contact with the toothed disk. For example, the planar member may be crescent shaped with an outside curvature roughly approximating the curvature of the sidewall, and an inside curvature roughly approximating the curvature of the toothed disk. The attachment makes an effective floor in the refiner chamber that is higher than the true bottom of the chamber, but it need not cover the entire surface of the chamber bottom. The toothed disk may rotate above, below, or in the same plane as the false floor attachment. The attachment itself may be slanted or curved across its surface, as desired, especially to agitate and direct the solid material in the chamber toward the rotating toothed disk.

Various embodiments of the invention have been illustrated and described above. It will be appreciated that changes can be made therein without departing from the spirit and scope of the invention. For example, the particle size gate 110 may be driven by mechanisms other than a driver bar 118 and hydraulic actuator 122 as described, including a manual mechanical adjustment of the gate position from the outside chamber. In another embodiment, a motorized, a motorized or manually-driven mechanism may be directly linked to the shaft 114 or to the particle size gate 110 itself. The gate 110 itself may be located above, below, or in the same plane as the floor 52. Alternative gate designs include multiple plates that cooperate to control the size of the exit hole 60. For example, the plates may be positioned to rotate inwards in the manner of a camera lens to constrict the size of the exit hole 60.

In yet a further embodiment of the invention, a smaller, recessed chamber may be defined in the floor 52 in which the rotating toothed disk is located. The toothed disk 56 may thus rotate above, below, or in the same plane as the floor 52. A cylindrical sidewall and a floor with one or more exit holes may be used to define this smaller chamber in which the toothed disk 56 rotates. The space beneath the disk 56 is used to collect and discharge the particulate matter. To increase the feed size of the refiner 10, the refiner 10 may additionally include a funnel or hopper positioned above the refiner chamber 12 to collect solid material and direct the solid material into the chamber 12. The funnel or hopper may rotate with the sidewall or remain stationary. In view of these and other alternative embodiments of the invention, it should be understood that the scope of the invention is not limited to the particular embodiments shown and described herein, but should be determined from the following claims and equivalents thereto.

The invention of claimed is:

1. A refiner chamber in which solid material is reduced to a particulate form, comprising:

(a) a rotatable sidewall;

(b) a bottom disposed across an end of the sidewall, wherein the bottom and the sidewall define a chamber;

(c) a tooted disk rotatably mounted within the chamber such that an edge of the toothed disk approaches near the rotatable sidewall;

(d) one or more attachments directly secured to the bottom, wherein the one or more attachments are secured to the bottom where the edge of the toothed disk approaches the rotatable sidewall, the one or more attachments being configured to limit the amount ad/or size of solid material tat can be held laterally between the sidewall and the toothed disk and reduced to a particulate form; and (e) one or more cleats on the interior surface of the sidewall, in which the cleats are configured to engage solid material in the chamber, direct the solid material toward the toothed disk, and act as an opposing member that helps hold the solid material laterally between the disk and the sidewall as the disk rotates and reduces the solid material to a particulate form.

2. The refiner chamber of claim 1, in which the one or more attachments is a riser plate formed of a surface extending in an upwards direction towards the toothed disk.

3. The refiner chamber of claim 2, in which the upward angle of the riser plate is adjusted to determine the amount and/or size of solid material that can be held between the sidewall and the toothed disk.

4. The refiner chamber of claim 1, in which the one or more attachments is a floor comb formed of one or more elements having an upper surface that is slanted upward in a direction towards the toothed disk.

5. The refiner chamber of claim 4, in which the one or more floor comb elements have a triangular cross-section.

6. The refiner chamber of claim 1, in which the one or more attachments are positioned on the bottom near the outer edge of the toothed disk.

7. The refiner chamber of claim 1, in which the sidewall and the toothed disk are configured to rotate in the same direction under normal operating conditions.

8. The refiner chamber of claim 1, in which the one or more attachments includes a false floor secured to the bottom that makes an effective floor in the chamber higher than the bottom.

9. The refiner chamber of claim 1, in which the rotatable sidewall has a rim that rides on a low-friction surface supporting the sidewall.

10. The refiner chamber of claim 1, further comprising one or more limiters positioned next to the sidewall to limit potential vertical movement of the sidewall.

11. The refiner chamber of claim 1, further comprising a low-friction surface positioned next to the sidewall to guide the sidewall when the sidewall is rotating.

12. The refiner chamber of claim 1, further comprising a rim scraper positioned at the open end of the sidewall to dislodge or push solid material from the open end inward into the chamber.

13. The refiner chamber of claim 12, further comprising a breaker bar positioned on the rim scraper at the open end of the sidewall to break up or reorient solid material in the chamber and direct the solid material toward the interior of the chamber.

14. The refiner chamber of claim 1, further comprising one or more pusher bars on the interior surface of the sidewall to push solid material in the chamber toward the toothed disk as the sidewall rotates.

15. The refiner chamber of claim 1, in which the bottom defines an exit hole through which particulate material may exit the chamber, the refiner chamber further comprising one or more scrapers on the lower interior surface of the sidewall next to the bottom to dislodge material that may have collected at the exit hole.

16. A refiner chamber in which solid material is reduced to a particulate form, comprising:

(a) a rotatable sidewall;

(b) a bottom disposed across an end of the sidewall, wherein the bottom and the sidewall define a chamber;

(c) a toothed disk rotatably mounted within the chamber such that an edge of the toothed disk approaches near the rotatable sidewalk;

(d) one or more attachments directly secured to the bottoms, wherein the one or more attachments are secured to the bottom where the edge of the toothed disk approaches the rotatable sidewall, the one or more attachments being configured to limit the amount and/or size of solid material that can be held laterally between the sidewall and the toothed disk and reduced to a particulate form; and (e) one or more baffles fanning one or more surfaces that extend from the sidewall inward into the chamber at an upper part of the chamber, wherein the one or more baffles do not extend near the bottom of the chamber.

17. The refiner chamber of claim 16, in which the surfaces of the one or more baffles limit material ricocheting off the sidewall from exiting the refiner chamber through the open end of the sidewall.

18. The refiner chamber of claim 16, in which one or more of the baffles extend from the sidewall at an angle relative to the surface of the sidewall.

19. The refiner chamber of claim 16, in which one or more of the baffles extend from the sidewall at an angle relative to the rotational axis of the sidewall.

20. The refiner chamber of claim 16, in which the width of one or more of the baffles extends into the chamber at least four inches.

21. The refiner chamber of claim 16, in which the width of one or more of the baffles extends into the chamber at least 10% of the radius of the chamber.

22. A refiner chamber in which solid material is reduced to a particulate form, comprising:

(a) a rotatable sidewall;

(b) a bottom disposed across an end of the sidewall, wherein the bottom and the sidewall define a chamber, and wherein the bottom defines an exit bole through which particulate material may exit the chamber;

(c) a toothed disk rotatably mounted within the chamber;

(d) one or more attachments secured to the bottom that limit the amount and/or size of solid material that can be held between the sidewall and the toothed disk and reduced to a particulate form; and (e) a movable gate capable of changing the size of the exit hole and regulating the size of particulate material that exits the chamber through the exit hole.

23. The refiner chamber of claim 22, in which the movable gate is further configured such that it can be positioned during the operation of the refiner chamber to change the size of the exit hole.

24. The refiner chamber of claim 22, further comprising an actuator linked to the movable gate to adjust the position of the gate.

25. The refiner chamber of claim 24, in which the actuator is configured to receive an actuating signal that directs the adjustment of the position of the gate.

26. The refiner chamber of claim 25, in which the actuating signal is received from a remote control via wired or wireless communication.

27. The refiner chamber of claim 22, in which the movable gate is connected via a shaft to a driver bar located below the bottom of the chamber.

28. The refiner chamber of claim 27, further comprising an actuator connected to the driver bar to adjust the position of the gate.

29. The refiner chamber of claim 27, further comprising a gate position indicator connected to the driver bar to indicate the relative position of the gate.

30. The refiner chamber of claim 22, further comprising a gate position indicator formed of a sensor that senses and reports the relative position of the gate.

31. The refiner chamber of claim 22, in which the gate has releasable fasteners that, when released, allow the gate to be moved, and when fastened, secure the position of the gate.

32. The refiner chamber of claim 31, in which the releasable fasteners are bolts that can be loosened to release the gate and tightened to fasten the gate.

33. The refiner chamber of claim 22, further comprising a guard plate that protects an edge of the movable gate.

34. The refiner chamber of claim 22, further comprising one or more cleats on the interior surface of the sidewall, in which the cleats are configured to engage solid material in the chamber, direct the solid material toward the toothed disk, and help hold the solid material as the disk rotates and reduces the solid material to a particulate form.

35. The refiner chamber of claim 22, further comprising one or more scrapers on the lower interior surface of the sidewall next to the bottom to dislodge material that may have collected at the exit hole.

36. The refiner chamber of claim 22, in which the one or more attachments is a riser plate formed of a surface extending in an upwards direction towards the toothed disk.

37. The refiner chamber of claim 36, in which the upward angle of the riser plate is adjusted to determine the amount and/or size of solid material that can be held between the sidewall and the tooted disk.

38. The refiner chamber of claim 22, in which the one or more attachments is a floor comb formed of one or more elements having an upper surface that is slanted upward in a direction towards the toothed disk.

39. The refiner chamber of claim 22, in which the one or more attachments includes a false floor secured to the bottom that makes an effective floor in the chamber higher than the bottom.

* * * * *

UNITED STATES PATENT AND TRADEMARK OFFICE

CERTIFICATE OF CORRECTION

PATENT NO. : 7,140,566 B2
APPLICATION NO. : 10/324545
DATED : November 28, 2006
INVENTOR(S) : J.H. Hughes It is certified that error appears in the above-identified patent and that said Letters Patent is hereby corrected as shown below:

| COLUMN | LINE | ERROR |
|---|---|---|
| 12 (Claim 1, line 6) | 25 | "tooted" should read --toothed-- |
| 12 (Claim 1, line 13) | 32 | "ad/or" should read --and/or-- |
| 12 (Claim 1, line 14) | 33 | "tat" should read --that-- |
| 13 (Claim 16, line 10) | 34 | "bottoms," should read --bottom,-- |
| 13 (Claim 16, line 17) | 41 | "fanning" should read --forming-- |
| 14 (Claim 37, line 4) | 57 | "tooted" should read --toothed-- |

Signed and Sealed this

Twenty-seventh Day of March, 2007

JON W. DUDAS
*Director of the United States Patent and Trademark Office*